US009175553B2

(12) United States Patent
McCann et al.

(10) Patent No.: US 9,175,553 B2
(45) Date of Patent: Nov. 3, 2015

(54) ELECTRIC AND BALLISTIC CONNECTION THROUGH A FIELD JOINT

(75) Inventors: Jason McCann, Cypress, TX (US); Mark Sloan, Magnolia, TX (US); James A. Weekley, Katy, TX (US)

(73) Assignee: Baker Hughes Incorporated, Houston, TX (US)

( * ) Notice: Subject to any disclaimer, the term of this patent is extended or adjusted under 35 U.S.C. 154(b) by 1118 days.

(21) Appl. No.: 12/511,878

(22) Filed: Jul. 29, 2009

(65) Prior Publication Data

US 2011/0024116 A1 Feb. 3, 2011

(51) Int. Cl.
*E21B 43/1185* (2006.01)
*H01R 24/38* (2011.01)
*H01R 103/00* (2006.01)

(52) U.S. Cl.
CPC ..... *E21B 43/1185* (2013.01); *H01R 24/38* (2013.01); *H01R 2103/00* (2013.01)

(58) Field of Classification Search
CPC ..... E21B 17/00; E21B 17/028; E21B 17/023; E21B 43/11; E21B 43/1185; H01R 24/38
USPC ..... 166/297, 376, 65.1, 55, 55.2
See application file for complete search history.

(56) References Cited

U.S. PATENT DOCUMENTS 2,414,349 A * 1/1947 Alexander ..... 166/299
2,615,080 A * 10/1952 Mathews et al. ..... 340/521
2,669,928 A * 2/1954 Sweetman ..... 175/4.6
2,821,136 A * 1/1958 Castel ..... 175/4.55
2,925,775 A * 2/1960 McKee ..... 175/4.56
3,246,707 A * 4/1966 Bell ..... 175/4.54
3,926,269 A * 12/1975 Cullen et al. ..... 175/104
5,027,708 A * 7/1991 Gonzalez et al. ..... 102/254
6,098,716 A * 8/2000 Hromas et al. ..... 166/297
6,412,388 B1 * 7/2002 Frazier ..... 89/1.15
7,461,580 B2 12/2008 Bell et al.
2003/0196806 A1 10/2003 Hromas et al.
2006/0196693 A1 9/2006 Bell et al.
2007/0247328 A1 10/2007 Petrovic et al.

FOREIGN PATENT DOCUMENTS

WO 2006093941 A2 9/2006

OTHER PUBLICATIONS

International Search Report and Written Opinion for PCT/US 2010/043625, dated Jan. 28, 2010, 9 pages.
International Preliminary Report on Patentability for PCT/US2010/043625, dated Jan. 28, 2011, 8 pages.

* cited by examiner

*Primary Examiner* — Elizabeth Gitlin
(74) *Attorney, Agent, or Firm* — Bracewell & Giuliani LLP

(57) ABSTRACT

A perforating system having annular connectors for attachment between adjacent perforating guns and connectors. The connectors include male and female connectors with respective outer and inner contact surfaces. The connectors also include attachment for electrical detonators and/or booster charges for transferring ballistic detonations between the perforating gun and connector sub.

24 Claims, 5 Drawing Sheets

38
39
41
40
32
30
42
33
34
56
58
57
50
52
53
54
46
36
41
39
30
44
34
35
40
32
56
52
50
58
57
53
54
60
55
62

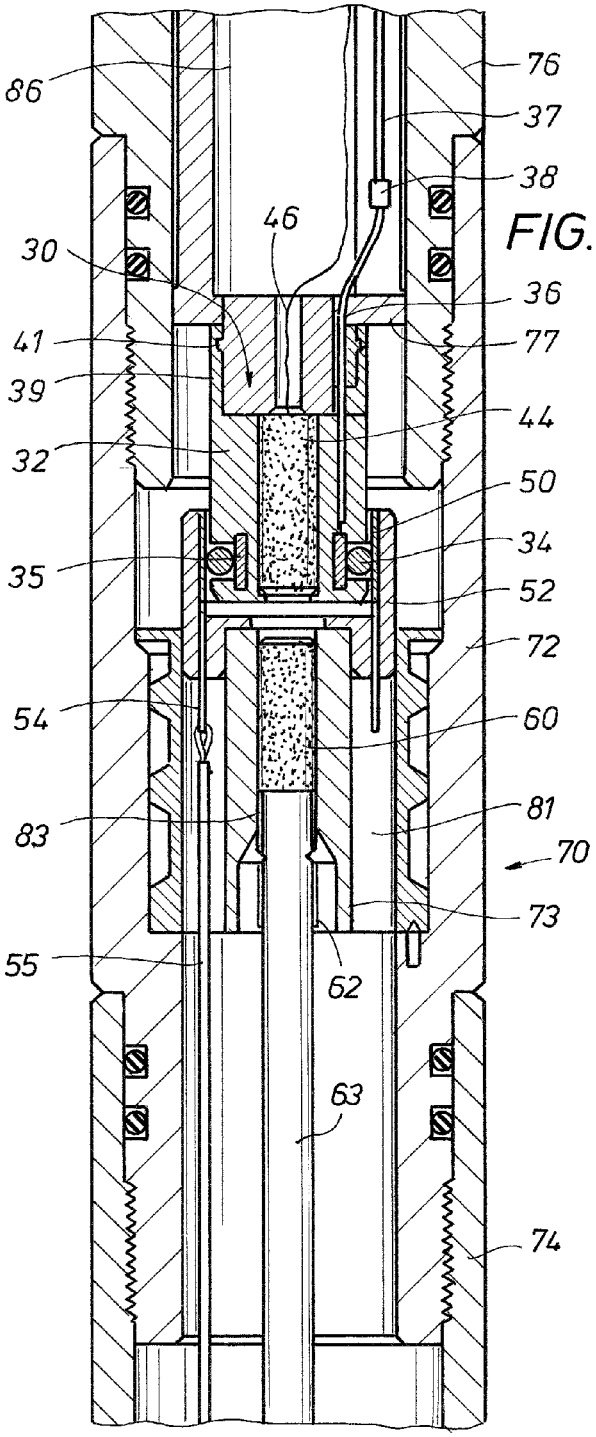
FIG.5A
FIG.5
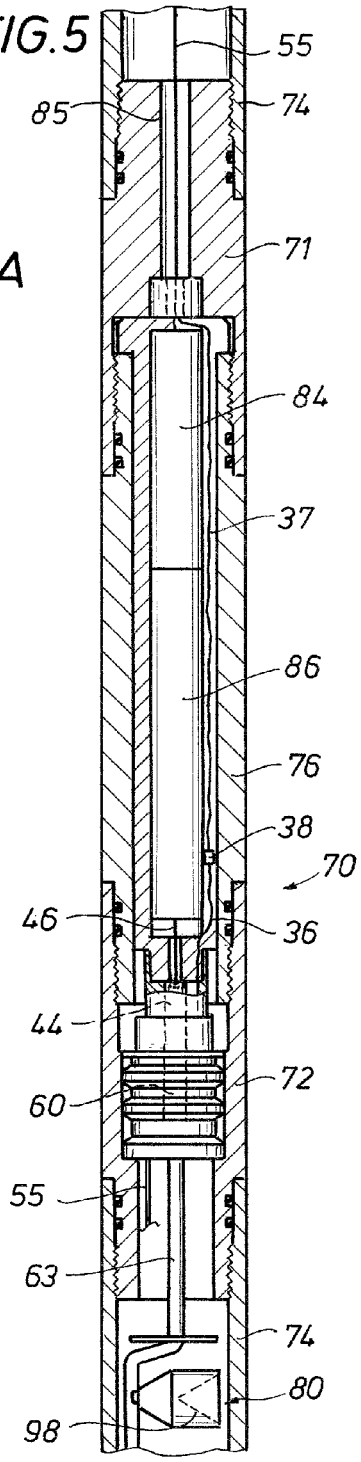

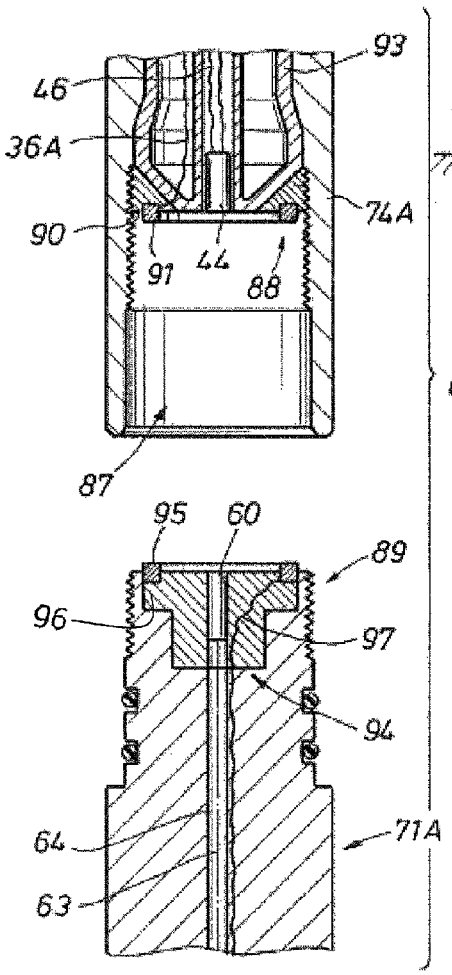
FIG.6
FIG.7
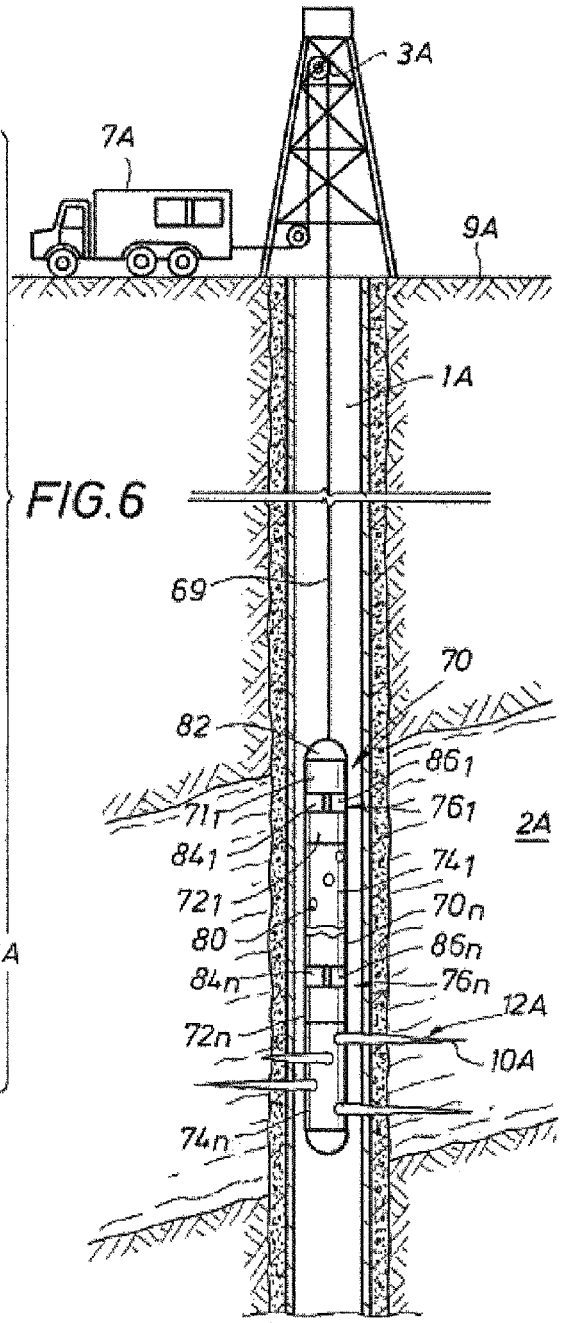

ELECTRIC AND BALLISTIC CONNECTION THROUGH A FIELD JOINT

BACKGROUND

1. Field of Invention

The invention relates generally to the field of oil and gas production. More specifically, the present invention relates to a perforating system having signal circuit connectors on adjacent members of a perforating string that can be put into direct contact.

2. Description of Prior Art

Perforating systems are used for the purpose, among others, of making hydraulic communication passages, called perforations, in wellbores drilled through earth formations so that predetermined zones of the earth formations can be hydraulically connected to the wellbore. Perforations are needed because wellbores are typically completed by coaxially inserting a pipe or casing into the wellbore. The casing is retained in the wellbore by pumping cement into the annular space between the wellbore and the casing. The cemented casing is provided in the wellbore for the specific purpose of hydraulically isolating from each other the various earth formations penetrated by the wellbore.

Perforating systems typically comprise one or more perforating guns strung together, these strings of guns can sometimes surpass a thousand feet of perforating length. In FIG. 1 an example of a perforating system 11 is shown having a perforating gun string 4 with perforating guns 6 coupled together by connector subs 13. The gun string 4 is shown disposed within a wellbore 1 on a wireline 5. The perforating system 11 as shown also includes a service truck 7 on the surface 9, where in addition to providing a raising and lowering means, the wireline 5 also provides communication and control connectivity between the truck 7 and the perforating gun 6. The wireline 5 is threaded through pulleys 3 supported above the wellbore 1. As is known, derricks, slips and other similar systems may be used in lieu of a surface truck for inserting and retrieving the perforating system into and from a wellbore. Moreover, perforating systems may also be disposed into a wellbore via tubing, drill pipe, slick line, coiled tubing, to mention a few.

Included with the perforating gun 6 are shaped charges 8 that typically include a housing, a liner, and a quantity of high explosive inserted between the liner and the housing. When the high explosive is detonated, the force of the detonation collapses the liner and ejects it from one end of the charge 8 at very high velocity in a pattern called a "jet" 12. The jet 12 perforates the casing and the cement and creates a perforation 10 that extends into the surrounding formation 2.

FIG. 2 is a side partial sectional view of a portion of a known perforating gun string 4 depicting an example connection between a perforating gun 6 and a connector sub 13. Also shown in FIG. 2 is an example detonation system for the shaped charges 8. The detonation system illustrated includes a detonation cord 15, that when ignited imparts a shock wave to initiate shaped charge 8 detonation. The system further includes an electrical circuit 14 that delivers electrical signals from the surface to initiators 17 for selectively igniting a specific detonation cord 15. Wire connectors 16 are shown within the circuit 14 for providing electrical communication between components within the circuit 14 and external to the circuit 14.

The circuits 14 therefore can be implemented for selective detonation of shaped charges 8 in specific perforating guns. Final assembly of the circuits 14, such as making up the wire connectors 16, is performed within the body of the guns 6.

Ports 18 with removable covers are shown for accessing the circuits 14 and connectors 16. The ports 18 however may leak when exposed to high pressures downhole. Moreover, wires of the circuit 14 that pass between adjacent connector subs 13 and guns 6 can become twisted or otherwise damaged during assembly.

SUMMARY OF INVENTION

Disclosed herein is a tool string of connected bodies with connections that can transmit signals and also transfer ballistic charges between the bodies. The signals can be electrical, electromagnetic, full spectrum light waves, radio waves, or combinations thereof. Also disclosed herein is a perforating system having annular connectors for attachment between adjacent perforating guns and connectors. The connectors include male and female connectors with respective outer and inner contact surfaces. In an embodiment, the connectors include attachment for detonator and/or booster charges for transferring ballistic detonations between the perforating gun and connector sub. In an example, disclosed is a perforating system that includes a first perforating string member having a first annular electrical contact, a first signal member in communication with the first annular electrical contact, and an end having a first connection fitting, a second perforating string member having a second annular element contact, a second signal member in communication with the second annular electrical contact, and an end having a second connection fitting selectively in a configuration attached with the end having a first connection fitting, so that when the end having a second connection fitting is attached to the end having the first connection fitting, the first and second annular electrical contacts are, in an embodiment, coaxially contacting, and the first and second signal members are in electrical communication. The perforating string members can be a perforating gun, a connecting sub, a booster sub, or a control sub. The first annular electrical contact may be a sleeve and the second annular electrical contact can be a split ring coaxially insertable within the sleeve to form an interference fit. The perforating system may further include an annular contact body threadingly attached to threads formed on an inner surface of the first perforating string member, threads on the end of the second perforating string member engageable with the threads on the first perforating string member, and a tiered contact body provided on the end of the second perforating string member, wherein the first annular electrical contact comprises a first ring on the annular contact body with a portion protruding from a surface of the body proximate the end, and wherein the second annular electrical contact comprises second ring on the tiered contact body with a portion protruding from a surface of the body proximate the end. The perforating system may optionally also have a plurality of first and second perforating string members, a control module associated with each first perforating string member and attached to each second signal member, and a signal circuit formed by the first and second members and the control module. In one example the control modules are arranged in parallel. The perforating system can alternatively further include a perforating gun, a connector sub connected to an end of the perforating gun, and a control module, wherein the first perforating string member comprises a control sub connected to an end of the connector sub opposite the perforating gun, the second perforating string member comprises a booster sub connected to the end of the control sub opposite the connector sub, wherein the perforating gun, connector sub, control sub, control module, and booster sub form a perforating string segment. In an embodiment, a series of repeating perforating string segments makes up a perforating string. A first body may circumscribe the first annular electrical contact, having a bore through the body, and a detonator disposed in the bore. Also optionally included is a second body circumscribing the second annular electrical contact, and a booster charge disposed in the second body, so that initiating the detonator forms a initiates booster charge detonation.

Also disclosed herein is a method of perforating that includes providing first and second perforating string members, first and second annular contacts coaxially disposed respectively in the first and second perforating string members, first and second signal members respectively in communication with the first and second contacts, a detonation assembly in communication with the second signal member, and shaped charges detonatable in response to activation of the detonation assembly, orienting the first and second perforating string members so they are on about the same axis; and contacting the first and second annular contacts by connecting the first and second perforating string members and also providing communication between the first and second signal members via contact between the first and second annular contacts. Corresponding threads may further be provided on the first and second perforating string members wherein connecting the first and second string members includes engaging the corresponding threads and rotating one or both of the first and second string members. The first annular electrical contact may be a sleeve and the second annular electrical contact can be a split ring coaxially insertable within the sleeve to form an interference fit. Optionally, a perforating string segment can be provided that includes a connector sub connected on one end to an end of a perforating gun and on its other end to the first perforating string member and the second perforating string member connected to the end of the first perforating string member opposite the connector sub, wherein the first perforating string member comprises an aiming sub and the second perforating string member comprises a booster sub. In an examples, multiple perforating string segments can be provided to form a perforating string, the method further including deploying the perforating string in a wellbore, sending a detonation signal to the perforating string that initiates detonation of shaped charges in a particular perforating gun in the perforating string. A detonator associated with the shaped charges can be provided and a controller in communication with the detonator adapted to initiate the detonator when instructed by the detonation signal. The controller is configurable to respond to a coded signal.

The present disclosure also describes an example of a connector assembly for use in transferring signals between adjacent members of a perforating string. In an example, the assembly includes an electrically conductive annular sleeve coupled to a first member of the perforating string, an electrical signal member connected to the annular sleeve, a resilient ring connector coupled to a second member of the perforating string coaxially and disposed in an interference fit within the annular sleeve, and a wiring harness connected to the ring connector and in electrical communication with the electrical signal member via coupling between the annular sleeve and resilient ring. The connector assembly may also have a first body circumscribing the annular sleeve, a bore axially formed through the body, a centralizer circumscribing a portion of the body, a detonator and/or booster charge in the centralizer aligned with the bore, and a detonating cord operatively coupled with the detonator and/or booster charge. Optionally included is a second body having a portion circumscribed by the ring connector, a bore through the second body, a booster and/or detonator in the bore in the second body directed at the detonator and/or booster charge in the first body. The wiring harness can be in electrical communication with a conveyance system attached to an upper end of the perforating string and the electrical signal member is in electrical communication with a detonator and/or booster disposed in a third perforating string member.

BRIEF DESCRIPTION OF DRAWINGS

Some of the features and benefits of the present invention having been stated, others will become apparent as the description proceeds when taken in conjunction with the accompanying drawings, in which:

FIG. 5 provides a side sectional view of the male and female connectors of FIGS. 4A and 4B in a portion of a gun string.

FIG. 5A illustrates an enlarged view of a portion of FIG. 5.

FIG. 6 provides an alternative example of a perforating string member connection.

FIG. 7 illustrates an example of a perforating string of the present disclosure in use.

Figure 1:
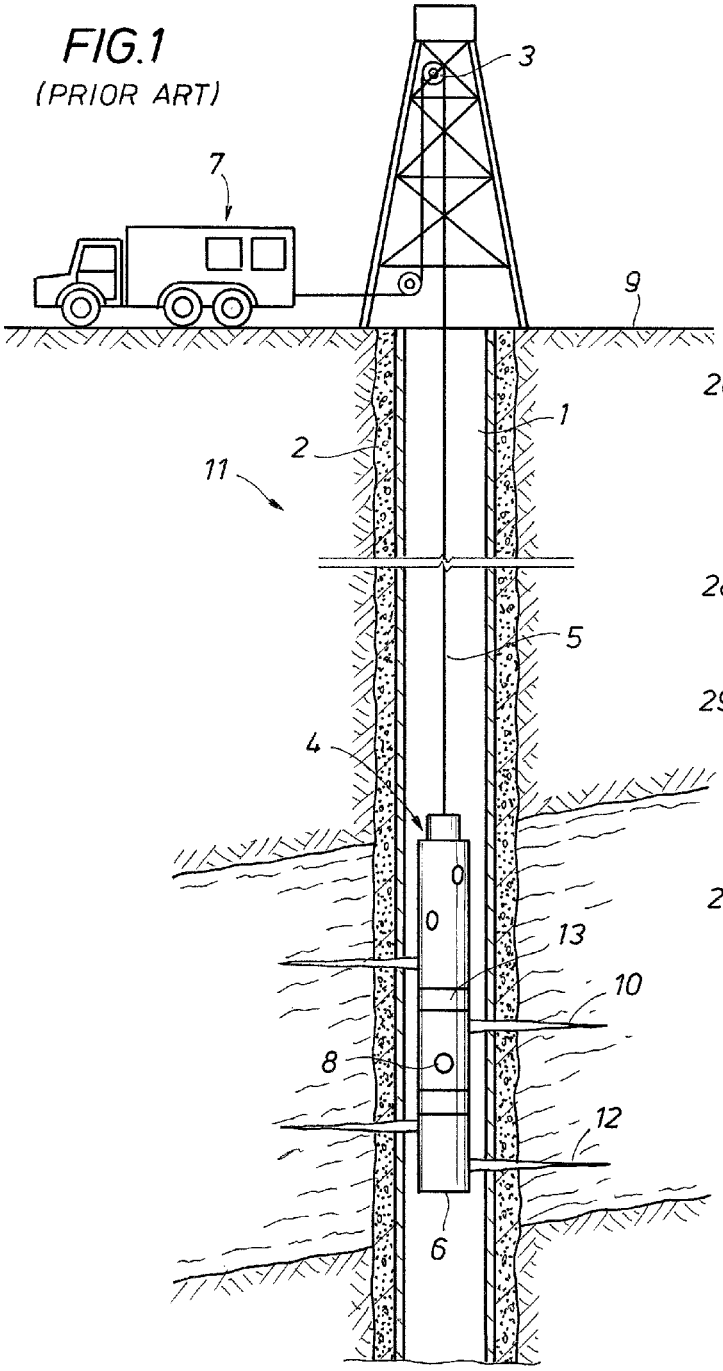
FIG.1 (PRIOR ART)
FIG. 1 is partial cutaway side view of a prior art perforating system in a wellbore.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

The method and system of the present disclosure will now be described more fully hereinafter with reference to the accompanying drawings in which embodiments are shown. The method and system of the present disclosure may be in many different forms and should not be construed as limited to the illustrated embodiments set forth herein; rather, these embodiments are provided so that this disclosure will be through and complete, and will fully convey its scope to those skilled in the art. Like numbers refer to like elements throughout.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation. Accordingly, the improvements herein described are therefore to be limited only by the scope of the appended claims.

Figure 3:
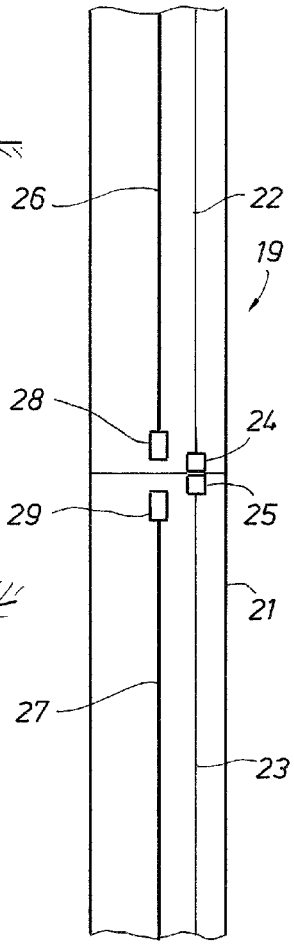
FIG. 3 is a schematic of an example of a tool string connection.
Figure 2:
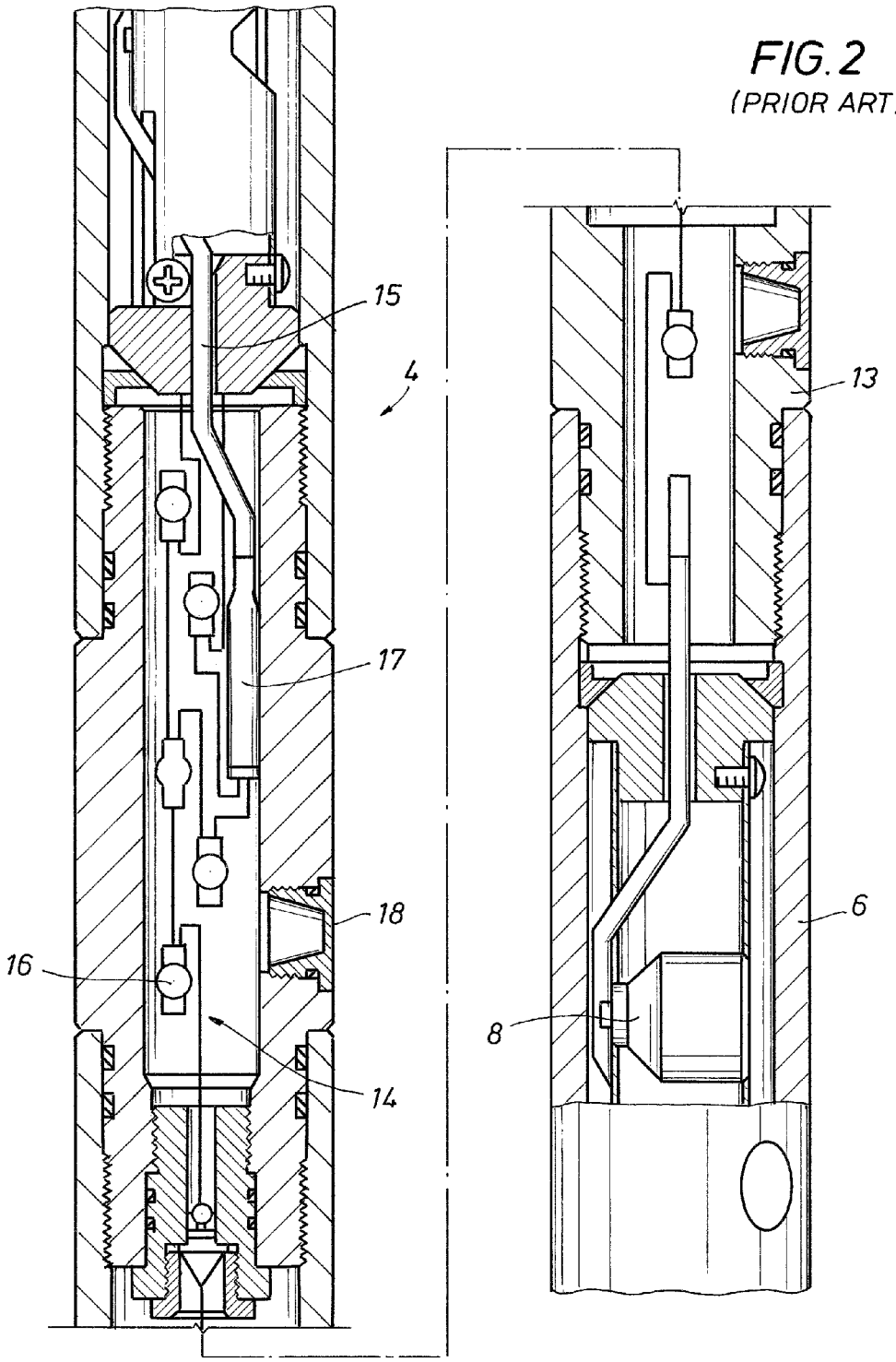
FIG. 2 (PRIOR ART)
FIG. 2 illustrates a side sectional view of a prior art perforating gun.

A portion of a tool string 19 embodiment is schematically depicted in FIG. 3, the tool string 19 portion includes string bodies 20, 21 attached end to end. Tool string 19 embodiments include any string insertable within a wellbore, such as a drill string, perforating string, logging string, workover strings, combinations thereof, and the like. Thus the string bodies 20, 21 can be a perforating gun(s), a perforating gun connector(s), a drill string element(s), a string sub(s), a control module(s), as well as a member(s) in a logging and/or a workover string(s). Signal lines 22, 23 are illustrated disposed respectively within the string bodies 20, 21. The signal lines 22, 23 are in signal communication with one another via signal line connectors 24, 25 provided on the line 22, 23 ends. The signal lines 22, 23 may be, wholly or partly, formed from any material or system for transmitting or conveying a signal. Signal embodiments include a message(s) (in digital or analog form having information), an electrical potential (that may or may not be time-varying either in presence or magnitude), an electromagnetic wave, that can be synchronous or asynchronous and may or may not have data embedded therein. Example electromagnetic waves include the full spectrum of light waves, radio waves, and microwaves. Example embodiments of signal lines 22, 23 include electrically conductive material such as wires, strips, semiconductors, superconductive material, composites, and combinations thereof. Alternatively, signal lines 22, 23 can be anything that transmits light waves, such as light pipes, optical fibers, reflective surfaces, and lenses. Yet further optionally, the signal lines 22, 23 can be a series of transmitters for relaying signal(s) along the string 19 to and from the bodies making up the string 19.

Example signal connectors 24, 25 include electrically conducting members that register with one another and are brought into electrical contact/communication when the bodies 20, 21 are attached. Optionally, the connectors 24, 25 may be annular rings (not shown) that connect with attachment of the bodies 20, 21, fiber optic couplers, and/or receiver transmitters. Yet further optionally, the bodies 20, 21 may include additional signal lines and connectors.

Further illustrated in the bodies 20, 23 are detonation cords 26, 27 through which a detonation wave may be transmitted. A first booster 28 is shown on the end of the detonation cord 26 adjacent the connection between the bodies 20, 21. In the embodiment of FIG. 3, a detonation wave may travel on the end of the detonation cord 26, opposite the detonator 28. On reaching the first booster 28, the detonation wave initiates the first booster 28 that in turn forms a ballistic detonation that transmits through the connection between the bodies 20, 21. A second booster 29 is shown on the end of the detonation cord 27 adjacent the connection between the bodies 20, 21. The second booster 29 is ignitable when exposed to the detonation transmitted from the first booster 28; igniting the second booster 29 forms a detonation wave in the detonation cord 27 that travels along the cord 27 away from the second booster 29. To ensure proper ballistic transfer between the bodies 20, 21 the first booster 28 and second booster 29 are placed in alignment. In one example, the first booster 28 and second booster 29 are coaxially disposed within their respective bodies 20, 21. Thus in one example of use the tool string 19 of FIG. 3 includes a connection enabling a ballistic transfer and a signal transfer. The first and second boosters 28, 29 may be substantially the same. Alternatively, the first booster 28 may include a transfer charge, so that detonation transfer can occur when the connection between the bodies 20, 21 includes a bulkhead or is otherwise sealed.

Figures 4A, 4B:
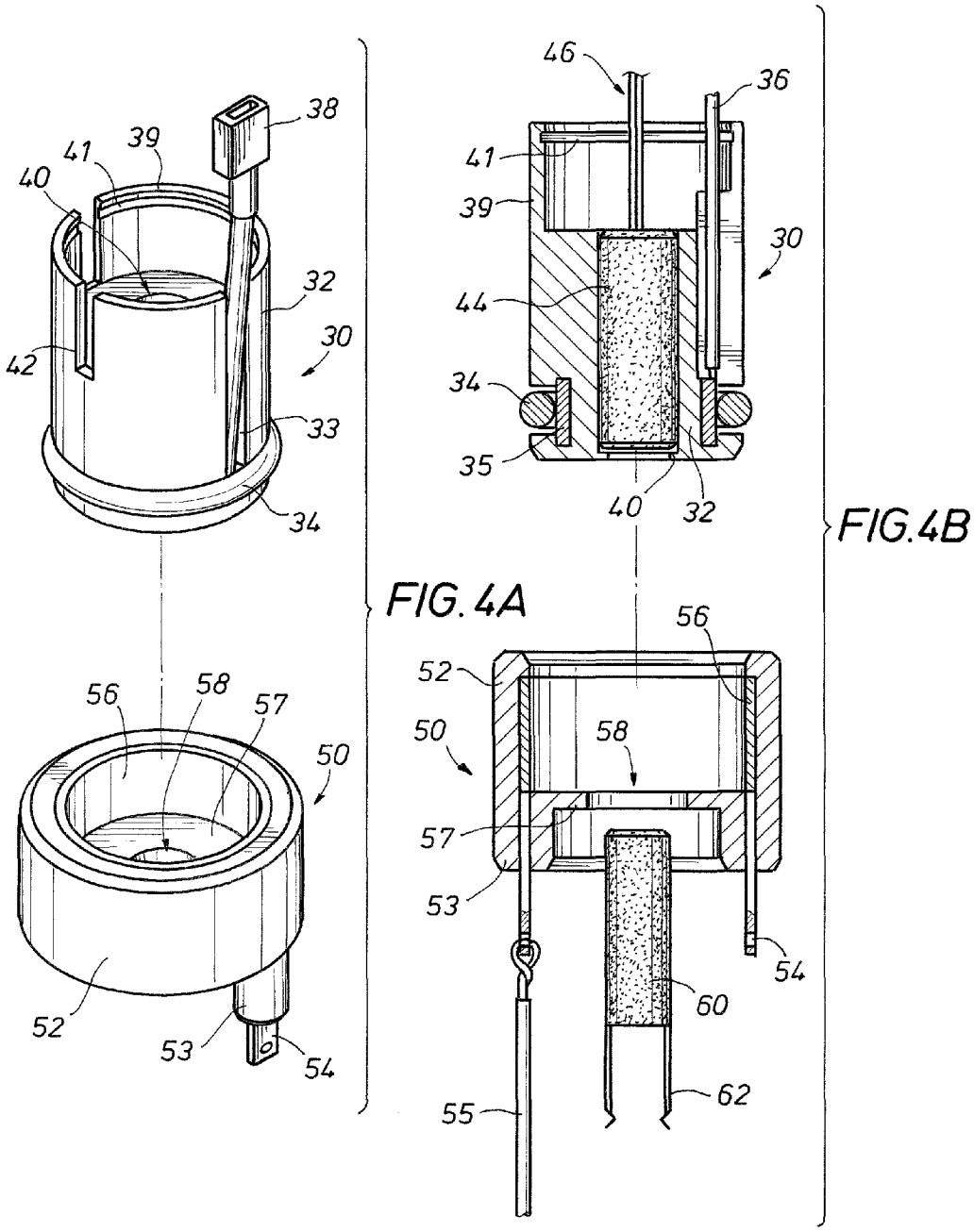
FIG. 4A depicts in a perspective view an example of male and female connectors.
FIG. 4B provides a side sectional view of an example of the male and female connectors of FIG. 4A.

FIGS. 4A and 4B provide an alternate embodiment of a connector enabling signal and ballistics communication between adjacent tool string members. The connectors of these figures can be used in a perforating system between adjacent string bodies. The connectors may be referred to as male and female connectors that are on separate string bodies and when the bodies are attached the connectors become coupled. An example of male and female connectors 30, 50 are illustrated in a side perspective view in FIG. 4A. The male connector 30 includes an annular cylindrical body 32 having an end circumscribed by an annular contact ring 34. A bore 40 extends axially through the body 32. Longitudinally formed along the body 32 on its outer surface is a channel 33 with a wiring harness 36 therein.

The female connector 50 of FIG. 4A includes an annular outer body 52 open on one side with a rear wall 57 on the other having a bore 58 therethrough. Coaxial within the body 52 is a circular contact sleeve 56 having a rearward lateral side abutting the rear wall 57. A rearward extension 53 is shown depending from the rear wall 57 away from the body 52. A tab connector 54 is partially housed within the rearward extension, a portion of which projects from the back of the rearward extension 53.

A side partial sectional view of the male and female connectors 30, 50 is provided in FIG. 4B. The wiring harness 36, as shown in FIG. 4B, has an end in electrical communication with the annular contact ring 34 and an electrical connector 38 attached its free end. Shown on the rearward portion of the connector 30 is an annular skirt 39 having an optional groove 41 formed on its inner surface and slots 42 formed longitudinal thereon. As illustrated in FIG. 4B, the wiring harness 36 attaches to an inner ring 35 coaxial between the contact ring 34 and body 32. The contact ring 34 and inner ring 35 may each or individually be, electrically conductive, resilient, and may include a split section (not shown). The split section allow the rings 34, 35 to be radially compressed and being formed from a resilient material, the rings 34, 35 will exert a force radially outward when compressed. A detonator 44 is shown co-axially inserted within the bore 40 in the embodiment of the male connector 30 of FIG. 4B. Transfer charge wires 46 connect to an end of the detonator 44. As will be described in more detail below, providing an electrical current through the charge wires 46 can initiate the detonator 44 to produce an explosive charge for detonating shape charges.

Shown in the sectional view of FIG. 4B, the tab connector 54 connects on an inward side with the contact sleeve 56. An electrical signal member 55 is shown attached to one of the tab connectors 54, as will be described in more detail below, the signal member 55 can be used for transmitting/receiving a signal to/from another portion within a perforating string. A booster charge 60 is positioned with a free end aligned with the bore 58 and its opposite end having a crimped connector 62. The booster charge 60 as shown is not connected, but illustrated in a position approximately to its assembled location.

FIGS. 5 and 5A depict an example of a perforating system 70 having the male and female connectors 30, 50 for transferring signals between adjacent perforating string members. For the purposes of discussion herein, signals includes data signals, electrical signals, and signals in the form of detonation waves. In the embodiment of FIGS. 5 and 5A, the male and female connectors 30, 50 are shown disposed within a booster sub 72, which is an annular member shown having a box connection configured to receive an end portion from an arming sub 76. A pin type connection on the booster sub 72 opposite side is inserted within the box type connection of a perforating gun 74.

As shown, the end of the male connection 30 having the annular contact ring 34 is inserted within the female connector 50 open end. This contacts the annular contact ring 34 on its outer surface to the contact sleeve 56 inner surface. As noted above, the optional split section in the rings 34, 35 allows them to be radially compressed when inserted within the contact sleeve 56. Due to the resilient material used in forming the rings 34, 35; when they are radially compressed by a force, up to their yield point, potential energy is stored in the rings 34, 35 forcing them outward into their pre-compressed state. Thus by dimensioning the rings 34, 35 and sleeve 56 so that the rings 34, 35 are radially compressed when inserted into the sleeve 56; stored stress in the rings 34, 35 forces them radially outward into sustained contact with sleeve 56. Electrical communication between the male and female connectors 30, 50 is initiated and maintained by the springlike interference fit between the rings 34, 35 and sleeve 56. The male connector 30 is supported within the booster sub 72 by a control sub sleeve 77. The skirt 39 portion of the connector 30 snaps over the sleeve 77 end. The groove 41 on the skirt 39 inner surface fits over a lip circumscribing the sleeve 77 end, the slots 43 expand to allow the skirt 39 to slide over the sleeve 77 end and the groove 41 to engage the lip.

Illustrated in schematic form in FIG. 5 is a control module 84 and a detonator electrical supply 86; both housed within the arming sub 76. In an example of use, the detonator electrical supply 86 selectively provides electrical current to the connected transfer charge wires 46 sufficient to activate the detonator 44. The control module 84 is operatively coupled to the detonator electrical supply 86 and regulates electrical current from the electrical supply 86. The control module 84 can include a printed logic circuit board with instructions stored in media thereon or hardwired within a circuit on the board. The detonator electrical supply 86 can have electrical energy stored therein, and thus can include a battery, a capacitor, or the like. Optionally, the detonator electrical supply 86 can include an electrical generator. The detonator electrical supply 86 may be separate or integral with the control module 84.

The step of regulating electrical current from the electrical supply 86 can include controlling when electrical current flows from the electrical supply 86, for how long the current flows, and how much current flows. The arming sub 76 has a pin type to box type connection to a connector sub 71 which is attached on its upper end and a pin to box type connection to the lower end of a perforating gun 74. Signal member 55 depending from an upper tab connector extends through the perforating gun 74, through a bore 85 axially formed through the connector sub 71 and terminates into connection at the control module 84. A bypass line 37 connects on one end to the signal member 55 and on the other to an electrical connector 38 of a wiring harness 36. Provided with each repeating section of the perforating system 70 are a signal member 55, bypass line 37, connector 38, wiring harness 36, rings 34, 36, sleeve 56, and tab connector 54 that form a circuit placing each control module 84 in parallel on the circuit.

Further depicted in FIGS. 5 and 5A is a detonating cord 63 shown attached within the crimped connector 62 on the booster charge 60. A centralizer 73 shown in the booster sub 72 has an annular receptacle 81 in which the rearward extension 53 of the female fitting 50 is inserted. The centralizer 73 supports and aligns the female connector 50 within the booster sub 72 for coupling to the male connector 30 when connecting the arming and booster subs 76, 72. Also in the receptacle 81 is the connection between the electrical signal member 55 and tab connector 54. The centralizer 73 also includes an axial bore 83 in which the booster charge 60 and crimped connector 62 are inserted. Placing the booster charge in the bore 83 aligns it with the detonator 44.

Alternative connectors between a perforating gun 74A and connector sub 71A are depicted in a side partial sectional view in FIG. 6. A gun box opening 87 in the perforating gun 74A is threaded on its inner surface in which a connector assembly 88 is threadingly connected. The connector assembly 88 includes an annular ring like contact body 90 threaded on its outer circumference for attachment to the threads on the perforating gun 74A. An annular contact 91 is included with the contact body 90 disposed coaxial with the perforating gun 74A and having at least a portion projecting upward from the contact body 90 towards the gun box opening 87. A tube base 93 is shown secured in the gun body 74A abutting a side of the contact body 90 opposite the annular contact 91.

A wiring harness 36A connects to the annular contact 90. Threads on the connector sub 70A define a connector sub pin end 89, where the threads are configured to attach to the threads in the perforating gun box opening 87. A contact assembly 94 is provided in the terminal end of the connector sub pin end 89 that includes a contact body 96. The contact body 96 is a cylindrically tiered member coaxially mounted at the sub 71A end. The contact body 96 shown includes two tiers, with the larger tier at the sub 71A end surface and facing the gun box opening 87. An annular ring contact 95 is mounted on the upper/outer surface of the larger tier and configured to substantially match the contour of the annular ring 91. A bore 64 is shown formed coaxial within the connector sub 71A that extends into the contact body 96. A booster charge 60 and associated detonating cord 63 are provided in the bore 64. A signal member 97 connects on one end to the annular ring 95 and extends into the connector sub 71A through the bore 64. Rotating one or both the connector sub 71A and perforating gun 74A while engaging their respective threads couples these members and also connects the assemblies 88, 94 thereby making up signal communication between the connector sub 71A and perforating gun 74A.

In FIG. 7, an example of use of the perforating system 70 described herein is schematically depicted in a side partial sectional view. A perforating system 70 in accordance with the present disclosure is deployed within a wellbore 1A for perforating into a formation 2A adjacent the wellbore 1A. A connected wireline 69 suspends the perforating system 70 in the wellbore 1A from a pulley system 3A. The wireline 69 upper end is shown terminating in a truck 7A on the surface 9A, from which the wireline 69 can be spooled. The truck 7A can include hardware and software for controlling and communicating with the system 70. Tubing, slickline, or other conveyance means can be used in place of a wireline. Alternatively a surface module at the surface 9A or remote from the wellbore 1A can be used for control and/or communication with the system 70 instead of the truck 7A.

The perforating system 70 of FIG. 7 includes a repeating string of perforating guns $\mathbf{74}_{1\text{-}n}$, each perforating gun $\mathbf{74}_{1\text{-}n}$ having a booster sub $\mathbf{72}_{1\text{-}n}$ attached on its upper end, and each booster sub $\mathbf{72}_{1\text{-}n}$ with an arming sub $\mathbf{76}_{1\text{-}n}$, wherein the arming sub $\mathbf{76}_{1\text{-}n}$ may be attached to an adjacent perforating gun $\mathbf{74}_{1\text{-}n}$ via a connector sub $\mathbf{71}_{1\text{-}n}$. As noted above, one or more particular perforating guns $\mathbf{74}_{1\text{-}n}$ within the perforating string 70 may be selectively activated by detonating shaped charges 80 in the particular gun $\mathbf{74}_{1\text{-}n}$. In the example shown, shaped charges 80 in the lower most perforating gun 74*n* have been detonated to produce perforations 10A in the formation 2A. The shaped charges 80 may include high explosive and a liner 98, so that igniting the high explosive creates jets 12A shown projecting radially outward from detonating shaped charges 80 that form the perforations 10A. After detonation, the system 70 can be relocated within the wellbore 1A and one or more particular undetonated perforating guns $\mathbf{74}_{1\text{-}n}$ within the string then detonated. Alternatively, subsequent detonations can take place without readjusting the gun string in the wellbore 1A.

Each control module $\mathbf{84}_{1\text{-}n}$ can be configured to respond based on a particular signal or signals, wherein module $\mathbf{84}_{1\text{-}n}$ response includes controlling the detonator electrical supply $86_{1-n}$. Electrical signals from the surface can be transmitted downhole via wireline 69 and transferred to the signal member 82 extending within the perforating string. The signal may be data encoded or may be a sequence of signals. The control modules 84 can be configured to register each signal sent down the wireline, but only act on signals that include a particular code. Optionally, the modules 84 can be configured to register only signals having a particular code. Full instructions for each control module 84 can be in the signals sent downhole or the control modules 84 can be equipped with one or more sets of instructions that are carried out depending on the signal content received. As shown in FIGS. 5 and 5A, the signal circuit places each control module 84 in parallel, thus each control module 84 in the string can receive a signal sent via the signal member 82. An optional signal circuit configuration places each control module 84 in series.

Based upon the particular signal in the signal circuit, the control module 84 can then activate the detonator electrical supply 86 so that electrical current is delivered to the detonator 44. However, if the signal received by the particular control module 84 is meant to detonate shaped charges 80 within a perforating gun 74 not associated with the control module 84; as described above, the control module 84 will not act until the appropriate signal is received. In situations when shaped charges 80 of other perforating guns 74 are to be activated, the signal can still pass to the wiring harness 36 via its associated connector 38 either within the control module 84 or through direct connection with the signal member 82. The signal within wiring harness 36 is conducted to the inner ring 35 and annular contact ring 34, transferred to the contact sleeve 56 in the female connector 50 and sent further down the string via electrical signal member 55. Accordingly, one of the advantages of the device described herein is the capability of providing connectivity, both electrical and detonation, between adjacent members within a perforating string 70.

The present invention described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. The signal members described herein can include anything through which a signal can travel. Examples include metallic elements, such as wires and/or strips, optical fibers, semiconductors, composites, combinations thereof, and the like. These and other similar modifications will readily suggest themselves to those skilled in the art, and are intended to be encompassed within the spirit of the present invention disclosed herein and the scope of the appended claims.

What is claimed is:

1. A tool string for use downhole comprising:

a first body having a first signal line in signal communication with a wireline;

a second body attached to the first body having a second signal line;

a signal line connection assembly coupled between the first and second bodies and that comprises a female connector with an annular contact sleeve, and a male connector that selectively inserts into the female connector, the male connector having an annular contact ring that circumscribes a first booster charge and that is coaxially disposed within the contact sleeve when the male connector inserts into the female connector and is in signal communication with the female connector, so that when the first and second bodies are attached the first and second signal lines are in signal communication through the signal line connection assembly; and a ballistics transfer assembly that comprises the first booster charge and that is coupled on the respective ends of the first and second bodies, so that when a detonation wave in the first body reaches the ballistics transfer assembly to form a ballistic detonation that transmits to the second body and initiates a detonation signal in the second body.

2. The tool string of claim 1, further comprising a first detonating cord in the first body coupled to an end of the first booster charge and a second detonating cord in the second body coupled to the end of the ballistics transfer assembly opposite the first detonating cord.

3. The tool string of claim 2, wherein the ballistics assembly further comprises a second, booster charge attached on an end of the second detonating cord, the first booster charge directed to the second booster charge.

4. The tool string of claim 1, wherein the first and second bodies are selected from a list consisting of a perforating gun(s), a perforating gun connector(s), a string sub(s), a control module(s), a drill string element(s), a logging string element(s), a workover string element(s), and combinations thereof.

5. The tool string of claim 1, wherein the first and second signal lines and the signal connection assembly are selected from the list consisting of electrically conducting elements, optical members, electromagnetic wave transfer elements, and combinations thereof.

6. A perforating system comprising:

a first perforating string member comprising:

a first annular contact comprising a first contact body that is threadingly attached to threads formed on an inner surface of the first perforating string member, and a first ring on the first contact body having a portion protruding from a surface of the first contact body;

a first signal member in communication with the first annular contact and in signal communication with a wireline;

an end having a first connection fitting;

a second perforating string member comprising:

a second annular contact comprising a tiered second contact body on an end of the second perforating string member proximate the first perforating string member, and a second ring on the second contact body that has a portion protruding from a surface of the second contact body;

a second signal member in communication with the second annular contact; and an end having a second connection fitting selectively in a configuration attached with the end having a first connection fitting, so that when the end having a second connection fitting is attached to the end having the first connection fitting, the first and second annular contacts are contacting and the first and second signal members are in signal communication;

detonating cord disposed in the first and second perforating string members; and threads on the end of the second perforating string member engageable with the threads on the first perforating string member, so that when the first and second perforating string members are engaged, the first ring contacts the second ring.

7. The perforating system of claim 6, wherein the perforating string members are selected from the list consisting of a perforating gun, a connecting sub, a booster sub, and a control sub.

8. The perforating system of claim 6, wherein the first and second annular contacts are coaxially arranged.

9. The perforating system of claim 6, wherein the first annular contact comprises a sleeve and the second annular contact comprises a split ring coaxially insertable within the sleeve to form an interference fit.

10. The perforating system of claim 6, further comprising a plurality of first and second perforating string members, a control module associated with each first perforating string member and attached to each second signal member, and a signal circuit formed by the first and second members and the control module, wherein the control modules are arranged in parallel.

11. The perforating system of claim 6, further comprising a perforating gun, a connector sub connected to an end of the perforating gun, and a control module, wherein the first perforating string member comprises a control sub connected to an end of the connector sub opposite the perforating gun, the second perforating string member comprises a booster sub connected to the end of the control sub opposite the connector sub, wherein the perforating gun, connector sub, control sub, control module, and booster sub form a perforating string segment.

12. The perforating system of claim 11, wherein the perforating system comprises a series of repeating perforating string segments.

13. The perforating system of claim 11, further comprising a second body circumscribing the second annular contact, and a booster charge disposed in the second body, so that initiating a detonator in the first perforating string member initiates booster charge detonation.

14. The perforating system of claim 6, further comprising a first body circumscribed by the first annular contact, a bore through the body, and a detonator disposed in the bore.

15. A method of perforating comprising:

providing first and second perforating string members each having a detonation cord, annular ring and sleeve contacts coaxially disposed respectively in the first and second perforating string members, a first signal member in communication with the ring contact and in signal communication with a wireline, a second signal member in communication with the sleeve contact, a detonation assembly in communication with the second signal member, a portion of the detonation assembly circumscribed by the ring contact, and shaped charges detonatable in response to activation of the detonation assembly;

orienting the first and second perforating string members so they are on about the same axis; and urging the first and second perforating string members in an axial direction and into connection, which also contacts together the strategically located ring and sleeve contacts into an interference fit to provide communication between the first and second signal members via contact between the ring and sleeve contacts.

16. The method of claim 15, wherein corresponding threads are further provided on the first and second perforating string members and wherein connecting the first and second string members includes engaging the corresponding threads and rotating one or both of the first and second string members.

17. The method of claim 15, wherein the ring contact comprises a split ring coaxially insertable within the sleeve to form an interference fit.

18. The method of claim 15, further comprising:

providing a perforating string segment that comprises a connector sub connected on one end to an end of a perforating gun and on its other end to the first perforating string member and the second perforating string member connected to the end of the first perforating string member opposite the connector sub, wherein the first perforating string member comprises an arming sub and the second perforating string member comprises a booster sub.

19. The method of claim 18, further comprising providing multiple perforating string segments to form a perforating string, deploying the perforating string in a wellbore, sending a detonation signal to the perforating string that initiates detonation of shaped charges in a particular perforating gun in the perforating string.

20. The method of claim 19, further comprising providing a detonator associated with the shaped charges and a controller in communication with the detonator adapted to initiate the detonator when instructed by the detonation signal.

21. The method of claim 20, further comprising configuring the controller to respond to a coded signal.

22. A connector assembly for use in transferring signals between adjacent members of a perforating string, the connector assembly comprising:

an electrically conductive annular sleeve coupled to a first member of the perforating string;

an electrical signal member connected to the annular sleeve;

a resilient ring connector coupled to a second member of the perforating string coaxially disposed in an interference fit with the annular sleeve and in electrical contact;

a wiring harness connected to the ring connector and in electrical communication with the electrical signal member via coupling between the annular sleeve and resilient ring;

a first body circumscribing the annular sleeve, a bore axially formed through the body;

a centralizer circumscribing a portion of the body; and a booster charge in the centralizer aligned with the bore, and a detonating cord operatively coupled with the booster charge.

23. The connector assembly of claim 22, further comprising a second body having a portion circumscribed by the ring connector, a bore through the second body, a detonator in the bore in the second body directed at the booster charge.

24. The connector assembly of claim 22, wherein the wiring harness is in electrical communication with a conveyance system attached to an upper end of the perforating string and the electrical signal member is in electrical communication with a detonator disposed in a third perforating string member.

* * * * *